US006968924B1

(12) United States Patent
Henson

(10) Patent No.: US 6,968,924 B1
(45) Date of Patent: Nov. 29, 2005

(54) SELF-ALIGNING ESCAPE SYSTEM ANCHOR

(75) Inventor: William E. Henson, Otter Lake, MI (US)

(73) Assignee: American Escape Systems, Inc., Rochester Hills, MI (US)

( * ) Notice: Subject to any disclaimer, the term of this patent is extended or adjusted under 35 U.S.C. 154(b) by 0 days.

(21) Appl. No.: 10/703,674

(22) Filed: Nov. 10, 2003

(51) Int. Cl.[7] ..... A62B 5/00
(52) U.S. Cl. ..... 182/70; 182/82; 182/3
(58) Field of Search ..... 182/70, 3, 82

(56) References Cited

U.S. PATENT DOCUMENTS 2,394,203 A * 2/1946 Pruder ..... 108/135
3,144,093 A * 8/1964 Proctor ..... 182/92
4,528,771 A * 7/1985 Rea, Jr. ..... 43/44.9
5,054,576 A * 10/1991 Glynn ..... 182/3
5,242,205 A * 9/1993 Garner ..... 296/136.01
5,342,229 A * 8/1994 Whitt ..... 441/6

* cited by examiner

*Primary Examiner*—Alvin Chin-Shue

(57) ABSTRACT

A compact, portable, self-aligning anchor for anchoring an emergency escape system to a building. The anchor is comprised of a thin wall hemi-spherical housing, a tubular rope guide extending through the housing, a short rope extending through the tubular rope guide and a carabiner clip on a distal end of the rope for attaching the anchor to the emergency escape system. The anchor is placed or tossed on to the floor of a room and the rope is passed under a bottom surface of an inward opening door. The door is closed, the distal end of the rope is pulled to self align the anchor at about a 45 degree angle with respect to the door and the rope is attached to the emergency escape system to anchor the escape system to the building.

7 Claims, 2 Drawing Sheets

SELF-ALIGNING ESCAPE SYSTEM ANCHOR

FIELD OF THE INVENTION

This invention relates to emergency escape systems and more particularly to a compact, portable, self-aligning anchor for anchoring an emergency escape system to a building.

BACKGROUND OF THE INVENTION

Emergency escape systems lower persons during emergencies, by way of example from upper stories of buildings during emergencies such as fires. One type of escape system consists of a descender and a lifeline. Several types of anchors for anchoring escape systems are well known in the art including window and door bars and anchors for attaching escape systems to floor, walls and window ledges.

These anchors suffer from a number of disadvantages such as, inconvenience, complexity and time consumption. During many emergencies time is of the essence. Delays in activating an escape system can produce injury or death. Another disadvantage is that some require adjustments. Another disadvantage is that some are difficult to store in readily accessible locations. Another disadvantage limitation is that some require tools to install.

SUMMARY OF THE INVENTION

The present invention is an anchor for an emergency escape system. The anchor is comprised of a hemi-spherical housing having a tubular rope guide; a short rope attached at one end to the housing and a carabiner clip attached to an opposite end portion of the lifeline. One important benefit of the anchor is that it is compact. Another important benefit is that it can be quickly applied. Another important benefit is that it is easy to use. Another important benefit is that it is self-aligning.

In employing the teaching of the present invention, a plurality of alternate constructions can be adopted to achieve the desired objects and capabilities. In this disclosure, one preferred embodiment is described. However, the disclosed embodiment is intended as an example only and should not be considered as limiting the scope of the invention.

Further objects, features and benefits will be apparent by reference to the drawings and ensuing detailed description of a preferred embodiment which discloses the best mode contemplated in carrying out the invention. The exclusive rights which are claimed are set forth in the numbered claims following the detailed description of the preferred embodiment.

BRIEF DESCRIPTION OF THE DRAWINGS

The invention will be better understood and further objects, characterizing features, details and advantages thereof will appear more clearly with reference to the diagrammatic drawings illustrating a preferred embodiment of the invention by way of non-limiting example only.

DETAILED DESCRIPTION OF A PREFERRED EMBODIMENT

Figure 2:
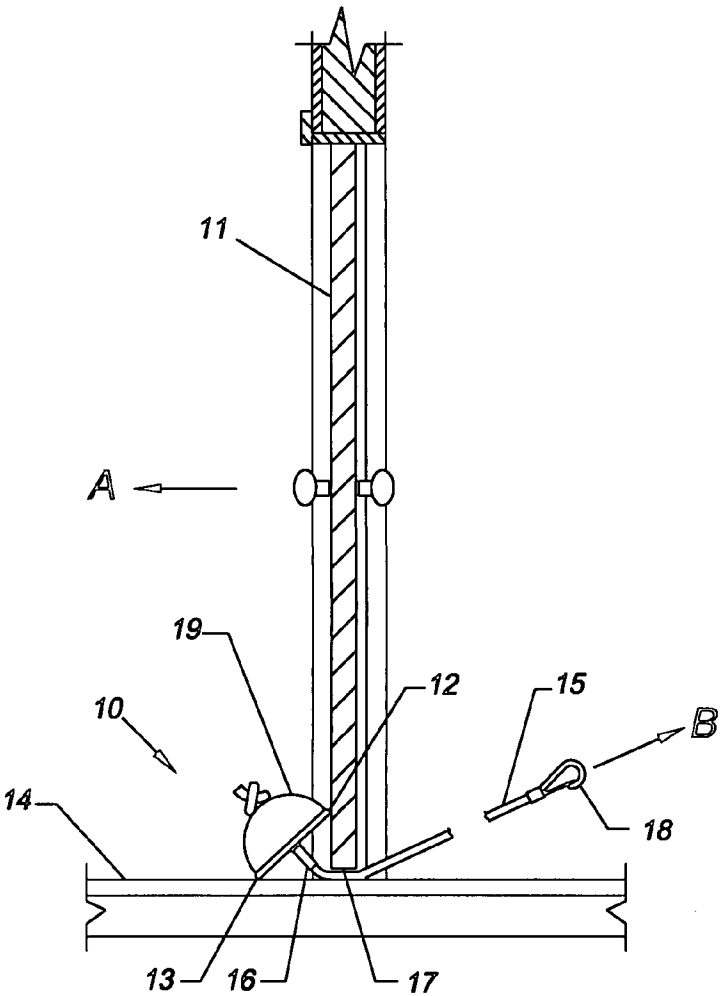
FIG. 2 is a cross-sectional view taken on the line 2—2 in FIG. 1.
Figure 1:
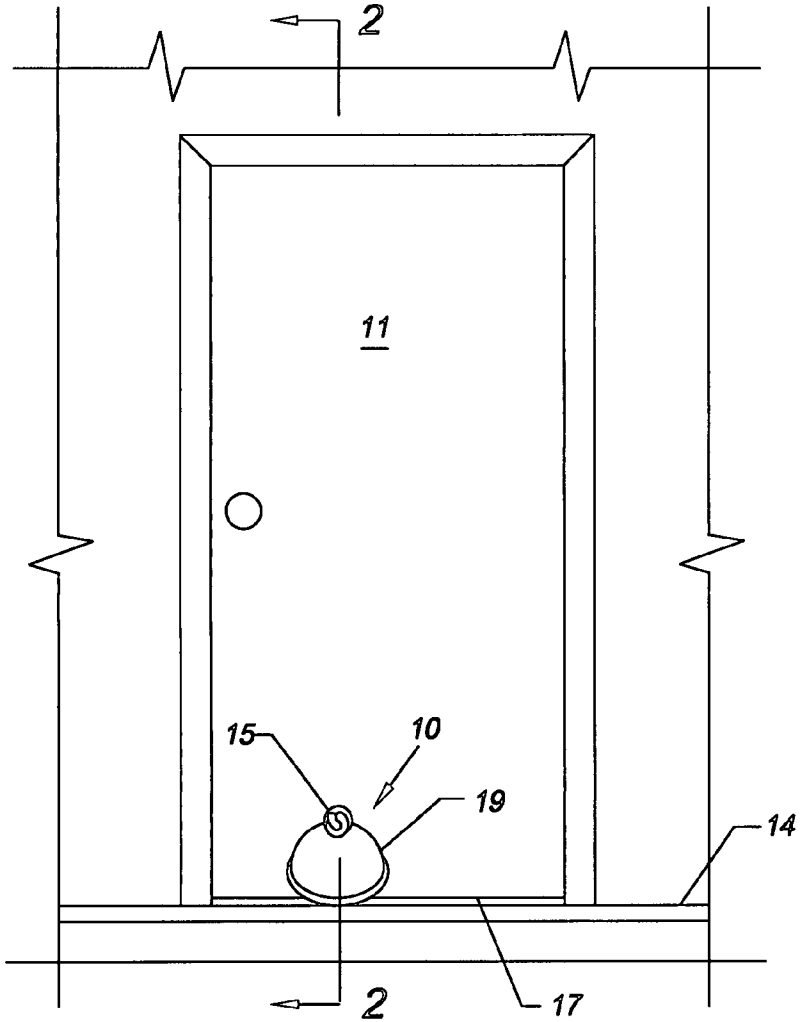
FIG. 1 is a broken front view of a wall and door of a building and a escape system anchor according to the present invention.

Referring now to the drawings wherein like numerals designate like and corresponding parts throughout the several views, an escape system anchor, designated by the numeral 10 is shown in FIGS. 1 and 2 in contact with a door 11 which opens inwardly in the direction of arrow A. As shown in FIG. 2, the anchor 10 is inclined toward the door 11 at about a 45 degree angle. An upper corner 12 of the anchor 10 bears against the door 11 and a lower corner 13 of the anchor 10 bears against a floor 14. A short rope 14 extends through a tubular rope guide 16 of the anchor 10 and passes under a lower surface 17 of the door and then upwardly in the direction of the arrow B. At a distal end of the rope 15 there is a carabiner clip 18 for attaching the anchor 10 to an emergency escape system (not shown).

Figure 3:
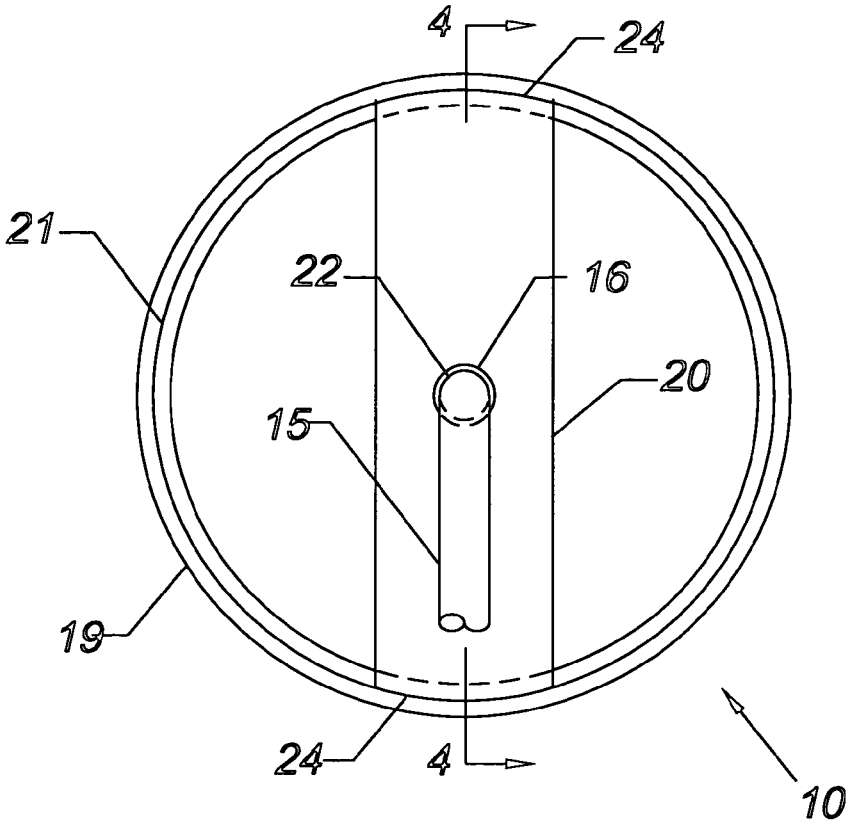
FIG. 3 is an enlarged rear view of the escape system anchor.
Figure 4:
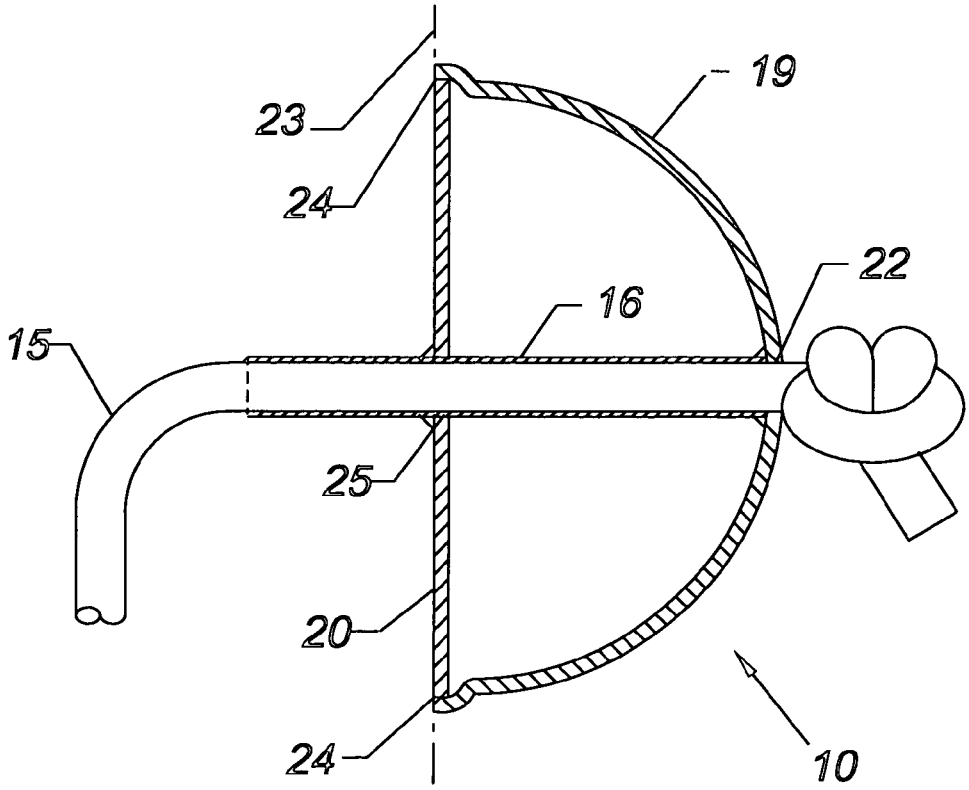
FIG. 4 is a cross-sectional view taken on the line 2—2 in FIG. 1.

A preferred construction of the anchor 10 is shown in FIGS. 3 and 4. The anchor 10 is comprised of a thin hemi-spherical housing 19, a rectangular plate 20 which spans a wide circular portion 21 of the housing 19, the tubular rope guide 16, the rope 15 and the caribiner clip 18. The spacial relationship between the semi-spherical housing 19 and the tubular rope guide 16 is an important requirement of the invention. As will be later understood, this relationship causes the anchor 10 to be self aligning at a 45 degree angle with respect to the door 10 and floor 14.

At a center of the spherical housing 19 there is an aperture 22 for receiving the rope 15, the size of the aperture 22 being about the same or slightly larger than the inside diameter of the tubular rope guide 16. The axis of the tubular rope guide 16 is aligned with the center of the aperture 22 and is perpendicular to a diametral plane 23 of the housing 19. An end portion of the tubular rope guide 16 is welded to an inner surface of the hemi-spherical housing 19 which surrounds the aperture 22. The large diametral open end portion 21 of the hemi-spherical housing 19 is expanded by a small amount to receive opposite outer edge portions 24 of the plate 20 which are preferably welded to the housing 19. The tubular rope guide 16 extends through an aperture 25 in the plate 20 and is joined to the plate 20 at the aperture 25 by welding or some other suitable means. The short rope 15 is pre-assembled to the housing 19 as shown in FIGS. 3 and 4.

The relationship between the rope guide 16 and hemi-spherical housing 19 is shown in FIG. 4. The rope guide 16 extends outwardly away from the plate 20 for a distance which is about 0.4 of the diameter of the hemi-spherical housing 19. By way of example, for a 5.00 inch diameter hemi-spherical housing 19, the rope guide 16 preferably extends about 2.00 inches outwardly away the plate 20 of the 5.00 inch diameter hemi-spherical housing 19. This relationship must be generally provided to self-align the anchor 10 with a door 11 and floor 14.

The anchor 10 is used as follows The anchor 10 is placed or tossed on to the floor 14 in the interior of a room behind an opening of a door 11. The short rope 15 which is attached to the housing 19 is passed through the clearance space below the partially opened door 11. Following this step the door 11 is closed, the rope 15 is pulled in the direction of arrow "B" and the carabiner clip 18 is connected to an escape system (not shown). It should be noted that when the rope 15 is pulled in the direction of the arrow "B" the anchor

10 is automatically aligned as shown in FIGS. 1 and 2 with the door 10 and floor 14. It should also be noted that the anchor 10 is effective regardless of its lateral position on the door 11.

From the foregoing, it is apparent that the present invention is a compact, easy to use, self-aligning anchor for an emergency escape system. Although only a single embodiment has been described, it will be appreciated that other embodiments can be derived by obvious changes in material and shape as well as eliminations, substitutions, inversions, and re-arrangement of parts known to persons skilled in the art without departing from the spirit thereof. By way of example, it is obvious that an integral cast one-piece hemi-spherical housing and rope guide can be substituted for the thin wall hemi-spherical housing and separate tubular rope guide. It is still further obvious that the distance the rope guide extends away from the housing can vary some what from 0.4 of the diameter of the housing or that the angle of the anchor can be other than 45 degrees without departing from the spirit thereof.

What is claimed is:

1. In combination with an interior door of a building, a compact, portable, self-aligning anchor of an emergency escape system for rescuing persons from said building, said anchor comprising: a hemi-spherical housing, said housing having a thin outer wall and a large circular diametral portion, and an aperture opposite said circular diametral portion; a plate having end portions attached to an outer edge of said circular diametral portion, said plate having an aperture which is aligned with said aperture of said housing; a tubular rope guide extending through said housing from said aperture of housing and through said plate and then outwardly from said plate tubular rope guide extends outwardly away from diametral portion of said plate for a distance which is about 0.40 the diameter of said diametral portion for self-aligning said anchor with respect to said interior door of said building, said tubular rope guide having an axis in perpendicular relationship with said circular diametral portion; a short rope having one end portion attached to said housing and a portion extending through said tubular rope guide; and a carabiner clip on an opposite end portion of said rope for attaching said emergency escape system.

2. In combination with an interior door of a building, a compact, portable, self-aligning anchor for of an emergency escape system for rescuing persons from said building, said anchor. comprising: a hemi-spherical housing, said housing having a large circular diametral portion, and an aperture opposite said circular diametral portion; a plate having end portions attached to an outer edge of said circular diametral portion, said plate having an aperture which is aligned with said aperture of said housing; a tubular rope guide extending through said housing from said aperture of housing and through said plate for self-aligning said anchor with respect to said interior door of said building, said tubular rope guide having an axis in perpendicular relationship with said circular diametral portion; a short rope having one end portion attached to said housing and a portion extending through said tubular rope guide; and a means on an opposite end portion of said rope for attaching said emergency escape system.

3. The anchor recited in claim 2 wherein said housing is comprised of a thin wall.

4. The anchor recited in claim 2 wherein said tubular rope guide extends outwardly away from said plate for a distance which is about 0.40 the diameter of said diametral portion.

5. The anchor recited in claim 2 wherein said means on an opposite end portion of said rope for attaching said emergency escape system is a carabiner clip.

6. In combination with an inward opening interior door of a building, a compact, portable, self-aligning anchor of an emergency escape system for rescuing persons from said building, said anchor, comprising: a hemi-spherical housing, said housing having a large circular diametral portion, a means extending outwardly from said circular diametral portion for guiding a rope away from said hemi-spherical housing and self-aligning said anchor at an angle with respect to said inward opening interior door of said building a rope having one end portion attached to said housing an opposite distal end portion; a means on said second end portion for attaching said emergency escape system.

7. The anchor recited in claim 6 wherein said angle of said anchor with respect to said inward opening door is about a 45 degrees.

* * * * *